United States Patent [19]

Khoja et al.

[11] 4,127,231

[45] Nov. 28, 1978

[54] SUPPORT ARM FOR CENTRIFUGAL LIQUID PROCESSING APPARATUS

[75] Inventors: Mirza A. Khoja, Columbia; Louis F. Gutierrez; John T. Perone, both of Silver Spring, all of Md.

[73] Assignee: Baxter Travenol Laboratories, Inc., Deerfield, Ill.

[21] Appl. No.: 850,622

[22] Filed: Nov. 11, 1977

[51] Int. Cl.[2] ..... B04B 13/00

[52] U.S. Cl. ..... 233/1 R; 233/24; 128/214 E; 128/DIG. 3; 233/19 R

[58] Field of Search ..... 233/1 R, 19 R, 21, 22, 233/27, 24, 26; 128/DIG. 3, 214 E; 250/564, 573

[56] References Cited

U.S. PATENT DOCUMENTS

| | | | |
|---|---|---|---|
| 2,692,725 | 10/1954 | Hensgen | 233/22 |
| 3,401,876 | 9/1968 | Lucas | 233/26 |
| 3,812,482 | 5/1974 | Clark | 128/214 E |
| 3,902,660 | 9/1975 | Barber | 233/26 |
| 3,986,442 | 10/1976 | Khoja et al. | 233/27 |

*Primary Examiner*—George H. Krizmanich
*Attorney, Agent, or Firm*—Henry W. Collins; Paul C. Flattery; Thomas R. Vigil

[57] ABSTRACT

The support arm is used in an apparatus for the centrifugal liquid processing of whole blood wherein whole blood is withdrawn from a donor and passed through a flexible tubing of a fluid system of the apparatus into a bowl thereof where the blood is centrifuged to separate the same into at least three components. One component which is to be collected is withdrawn through a flexible tubing at a fixed rate of volumetric displacement while the other two components are withdrawn through flexible tubings at variable rates of volumetric displacement. The other two components are recombined and returned to the donor. The withdrawal of the one component is optically monitored to determine whether or not either one of the other components is being mixed with the one component. The support arm is positioned above the bowl for guiding the tubings to the bowl in a first position and is pivotal horizontally to a second position where the bowl can be easily removed. A releasable latch member holds the arm in the first position and mounts an optical sensing system for monitoring the withdrawal of the one component through a light transmissive portion of the flexible tubing, through which the one component is being withdrawn.

14 Claims, 10 Drawing Figures

SUPPORT ARM FOR CENTRIFUGAL LIQUID PROCESSING APPARATUS

CROSS REFERENCE TO RELATED APPLICATIONS

This application is related to co-pending application Ser. No. 850,624, filed Nov. 11, 1977 and entitled *METHOD AND APPARATUS FOR SEPARATING WHOLE BLOOD INTO COMPONENTS THEREOF AND FOR AUTOMATICALLY COLLECTING ONE OF THE COMPONENTS THEREOF* and to co-pending application Ser. No. 850,621, filed Nov. 11, 1977 entitled *IMPROVED ROTOR DRIVE ASSEMBLY FOR A CENTRIFUGAL LIQUID PROCESSING APPARATUS,* the disclosures of which are incorporated herein by reference.

BACKGROUND OF THE INVENTION

1. Field of the Invention

The present invention relates to a support arm assembly for supporting tubings leading to a rotatable bowl in an apparatus for separating whole blood into components thereof and for automatically collecting one of the components.

2. Description of the Prior Art

Heretofore various apparatus have been proposed for separating whole blood into at least three components thereof, such as a centrifugal liquid processing apparatus where a rotor assembly having a container or bowl for receiving the whole blood to be processed by centrifugation is rotated in the apparatus to cause separation of the whole blood into red blood cells at the outer radius, a buffy coat of white blood cells at an intermediate radius and plasma containing platelets at an inner radius of the bowl. Outlets are provided on the bowl at the different radii and tubings are connected to the outlets. Pumps are provided for withdrawing each of the blood components which collects at one of the radii and at a zone adjacent each of the outlets. The outlets are coupled to the tubings either directly or by means of a fluid seal. When they are connected directly, twisting is prevented by reason of the rotor assembly being driven at a speed twice the speed of a coaxial member mounting a cable holding device through which the tubings pass to reach the bowl in the rotor assembly. As a result of the different speeds of the coaxial member and the rotor assembly, twisting is prevented. A further explanation of an apparatus having such an arrangement can be found in U.S. Pat. No. 3,986,442.

In the apparatus disclosed in U.S. Pat. No. 3,986,442, an arm holding the umbilical cable guides or trains the cable containing the tubings downwardly generally on the axis of rotation of the rotor assembly. This arm is fixed.

As will be described in greater detail hereinafter, the support arm assembly of the present invention differs from the prior arm by providing a horizontally pivotal arm portion which can be pivoted away from the axis of the rotor assembly to facilitate removal of a bowl mounted in the rotor assembly.

SUMMARY OF THE INVENTION

According to the invention, there is provided in an apparatus which is of the type that includes a centrifuge device having a closed bowl into which liquid is supplied and/or from which liquid is withdrawn by means of at least one flexible tubing, an improved support arm assembly which is mounted on the apparatus, which extends over the bowl of the centrifuge device and which has passage means at the free end thereof located centrally of and above the bowl for receiving therethrough at least one flexible tubing, said support arm assembly being a pivotal arm assembly which has a base portion fixed to the apparatus and an arm portion pivotally connected to said base portion and pivotal from a first position over the bowl of the centrifuge device to a second position away from the bowl in which second position the bowl can be removed from the centrifuge device.

DESCRIPTION OF THE PREFERRED EMBODIMENT

Figure 1:
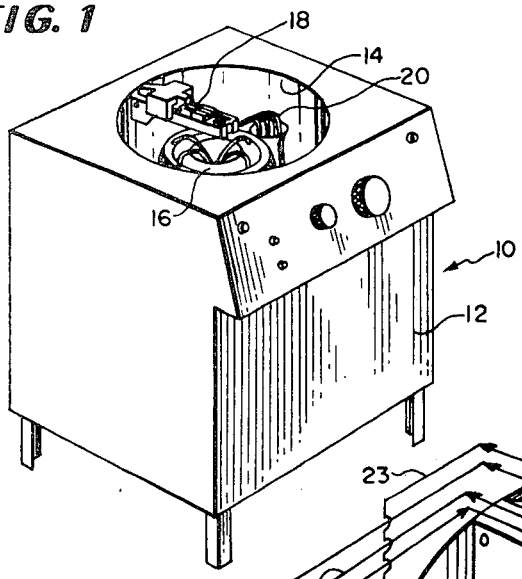
FIG. 1 is a perspective view of a centrifugal liquid processing apparatus utilizing the support arm assembly of the present invention.

Referring to the drawings in greater detail there is generally illustrated in FIG. 1 a centrifugal liquid processing apparatus 10 for separating whole blood into components thereof. The apparatus 10 includes a cabinet 12 having a generally cylindrical opening 14 in the top thereof in which is situated a centrifuge device 16. Extending from an inner wall of the cylindrical opening 14 is a support arm assembly 18, the outer end of which is located over and centrally of the centrifuge device 16. A group 20 of four flexible tubings extend through the outer end of the arm assembly 18 for connection to the centrifuge device 16.

Figure 2:
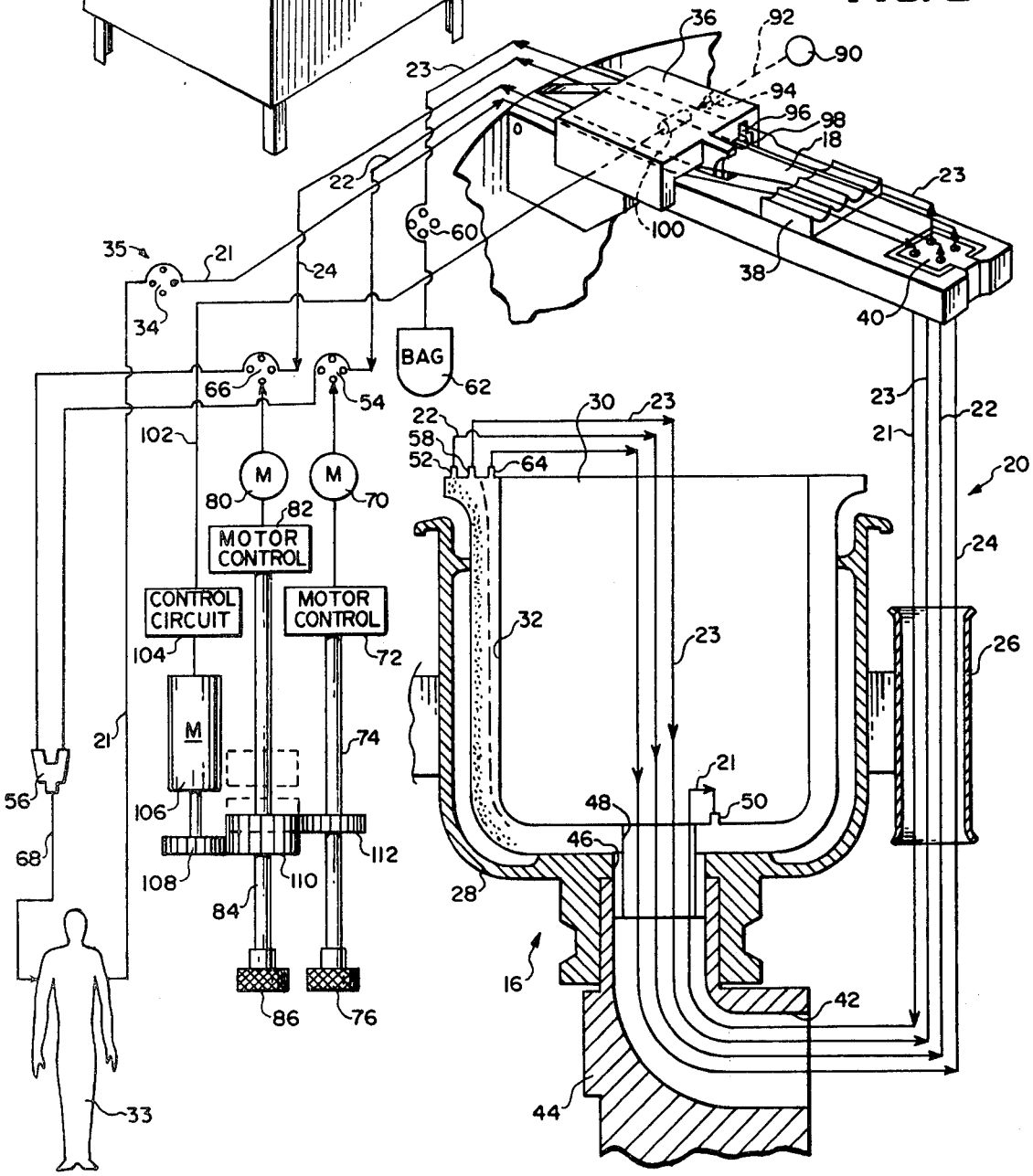
FIG. 2 is a schematic diagram of the fluid system of the apparatus shown in FIG. 1 and of the electromechanical control system for the apparatus including fragmentary portions of the apparatus.

As best shown in FIG. 2, the group 20 of the tubings comprises four tubings 21, 22, 23 and 24 which extend from the arm assembly 18 through a tubular sleeve 26 mounted to the side of a container holding receptacle 28 of the centrifuge device 16. Mounted in the centrifuge device 16 is a closed bowl 20 having a hollow interior 32 in which whole blood is centrifuged as will be described hereinafter in greater detail.

Referring to FIG. 2, the first tubing 21 is coupled in a conventional manner to a donor 33 and passed over and forms part of a peristaltic pump 34 which is operable to withdraw whole blood from the donor 33. Although not shown, it will be understood that suitable low and high pressure sensors are provided in the tubing 21 to sense high and low pressure conditions indicating a leak in the fluid system of the apparatus 10, which system is generally identified by reference numeral 35, or an occluded vein in the donor 33. When such a condition is sensed, the low and/or high pressure sensors are then operative to stop operation of the apparatus 10.

After leaving the peristaltic pump 34, the tubing 21 is directed into the apparatus 10 and onto the arm assembly 18 beneath a latch member 36 which is part of and which holds the arm assembly 18 in place and at the same time holds the tubings 21–23 on the arm assembly 18. From there the tubing 21 is trained over a tubing guide member 38 mounted on the arm assembly 18 and then through an aperture in a tubing holder 40 located at the outer end of the arm assembly 18. Then the tubing 21 passes through the tubular sleeve 26 and into a passageway 42 formed in a drive shaft 44 of a rotor drive assembly for the centrifuge device 16.

As shown, the passageway 42 is L-shaped and extends from a side of the drive shaft 44 radially inwardly and axially upwardly of the drive shaft 44 and into mating engagement with an opening 46 in the container holding receptacle 28 and through a mating opening 48 in the bottom of the bowl 30 where it connects to an inlet 50 to the hollow interior 32 of the bowl 30.

Within the bowl 30 red blood from the donor is centrifuged upon rotation of the bowl 30 with red blood cells collecting at an outer radius, a buffy coat of white blood cells collecting at an intermediate radius, and plasma with platelets therein collecting at an inner radius within the hollow portion 32 of the bowl 30. An outlet 52 is provided on the upper rim of the bowl 30 at the outer radius and adjacent a zone where the red blood cells collect. The second tubing 22 is connected to this outlet 52 and extends therefrom through the passages 48 and 42, the sleeve 26, the apertured holder 40, over guide member 38 under the latch member 36 and then over and forming a part of a peristaltic pump 54 and from there to a Y-coupling 56.

In like manner the third tubing 23 is connected to an outlet 58 on the upper rim of the bowl 30 at the intermediate radius and adjacent a zone where a buffy coat of white blood cells collects in the hollow interior 32 of the bowl 30. The tubing 23 then passes through the passages 48 and 42 through the sleeve 26, the apertured holder 40, over guide member 38 and underneath the latch member 36 and then over and forming part of a peristaltic pump 60 to a white blood cell collection bag or receptacle 62.

Again, in like manner, the fourth tubing 24 is connected to an outlet 64 located on the upper rim of the bowl 30 at an inner radius where plasma collects. From there the tubing 24 extends through the passages 48 and 42, the sleeve 26, the apertured holder 40, over the guide member 38, under the latch member 36 and then over and forming part of a peristaltic pump 66 from which the tubing 24 extends to the Y-coupling 56 where plasma and red blood cells are recombined and returned via a tubing 68 to the donor 33.

As shown, the peristaltic pump 54 is driven by a motor 70, the speed of which is controlled by a motor control 72 which is operated by a rotatable control rod 74 having a knob 76 on the outer end thereof for manual operation of the motor control 72. Typically, the motor control 72 will include an adjustable potentiometer which has a rotating sweep arm that is rotatably coupled to the rod 74 such that rotation of the knob 76 will cause adjustment of the potentiometer thereby to cause the motor control 72 to change the speed of the motor 70 for changing the speed of the pump 54.

Likewise, the peristaltic pump 66 is driven by a motor 80, the speed of which is controlled by a motor control 82 having a rod 84 extending therefrom. The rod 84 also has a knob 86 at the outer end thereof. In a similar manner to the motor control 72, the motor control 82 has a potentiometer with a rotating sweep arm which is rotatably coupled to the rod 84 such that rotation of the knob 86 will adjust the setting of the potentiometer to cause the motor control 82 to change the speed of the motor 80 and thereby the speed of the pump 66.

A light source 90 and a light (fiber optic) pipe 92 transmit light from the light source 90 to a passageway 94 in the latch member 36. The passageway 94 opens into a groove 96 in the latch member 36, which groove is aligned with a boss 98 mounted on the arm assembly 18. The boss 98 holds the light transmissive portion of the tubing 23 in the groove 96 so that light entering the passageway 94 is passed through the light transmissive portion of the tubing 23 to a light pickup device 100 in an aligned passageway 101 in the latch member 36 so that the optical density of the white blood cells being withdrawn through the tubing 23 can be sensed and monitored by light pickup device 100.

The light pickup device 100 can be a fiber optic pipe or can be a sensor with an electrical conductor leading therefrom. In either event there is illustrated in FIG. 2 a line 102 from the light pickup device 100 which can be a continuance of the device 100, namely, a fiber optic light pipe or which can be an electrical conductor, either of which is connected to a control circuit 104. As will be described in greater detail hereinafter, the control circuit 104 is operable to drive a gear drive motor 106 which is connected to a gear 108. The gear 108 is adapted to mesh with a gear 110 on the rod 84 which in turn meshes with a gear 112 on the rod 76 as shown in FIG. 2.

The control circuit 104 determines whether or not the light (optical density) received by the light pickup device 100 is within a predetermined range and whether or not the optical density is increasing or decreasing. Then, depending upon the optical density sensed and whether it is increasing or decreasing the control circuit 104 will cause various rotations of the motor 106 and gear 108, thereby to cause the gear 110 to rotate in a clockwise or counterclockwise direction which in turn will cause the gear 112 to rotate in a counterclockwise or clockwise direction. Such rotations of the gears 110 and 112 will cause an adjustment of the potentiometers in the motor control circuits 82 and 72 to effect corresponding changes, but in opposite directions, in the speeds of the motors 70 and 80. In this respect, when the speed of motor 80 is increased or decreased, the speed of the motor 70 is decreased or increased.

Briefly, summarizing the operation of the electromechanical system of the apparatus 10, which system is generally identified by reference numeral 113, when the density of the buffy coat of white blood cells being withdrawn darkens beyond a predetermined range, defining a desired composition of the buffy coat being withdrawn, the control circuit 104 will cause the speed of motor 70 to be increased and the speed of motor 80 to be decreased so that more red blood cells and less plasma are withdrawn from the bowl 30. In this way the zone containing the desired composition of a buffy coat of white blood cells is maintained at the radius of the outlet 58.

In like manner when the optical density of the buffy coated sensed is below the predetermined range indicating that more plasma is in the buffy coat than is desired, the control circuit 104 will cause the motor 106 to rotate the gear 108 so as to cause the motor control 82 to increase the speed of the motor 80 and the motor control 72 to decrease the speed of the motor 70 thereby to withdraw more plasma and less red blood cells and maintain the zone of the buffy coat having the desired composition of white blood cells at the radius of the outlet 58.

To provide greater flexibility in the apparatus 10 the rod 84 is axially movable between three positions, the first position being that shown solid in FIG. 2 where the gear 110 engages the gear 108 and the gear 112. In a second position, the rod 84 is moved inwardly toward the motor control 82 to a position where the gear 100 shown in phantom lines does not engage the gear 108 but only the gear 112. In this position, only manual adjustment of the speeds of the pumps 54 and 66 can be effected and in this position adjustment of one knob 86 causes an equal adjustment but in the opposite direction of the other knob 76.

In the third position, the gear 110, again shown in phantom lines, does not engage either of the gears 108 or 112. In this position, the speed of the pumps 54 and 66 and the respective rates of withdrawal of fluids through the tubings 22 and 24 are each controlled separately by the knobs 86 and 76.

Figure 3:
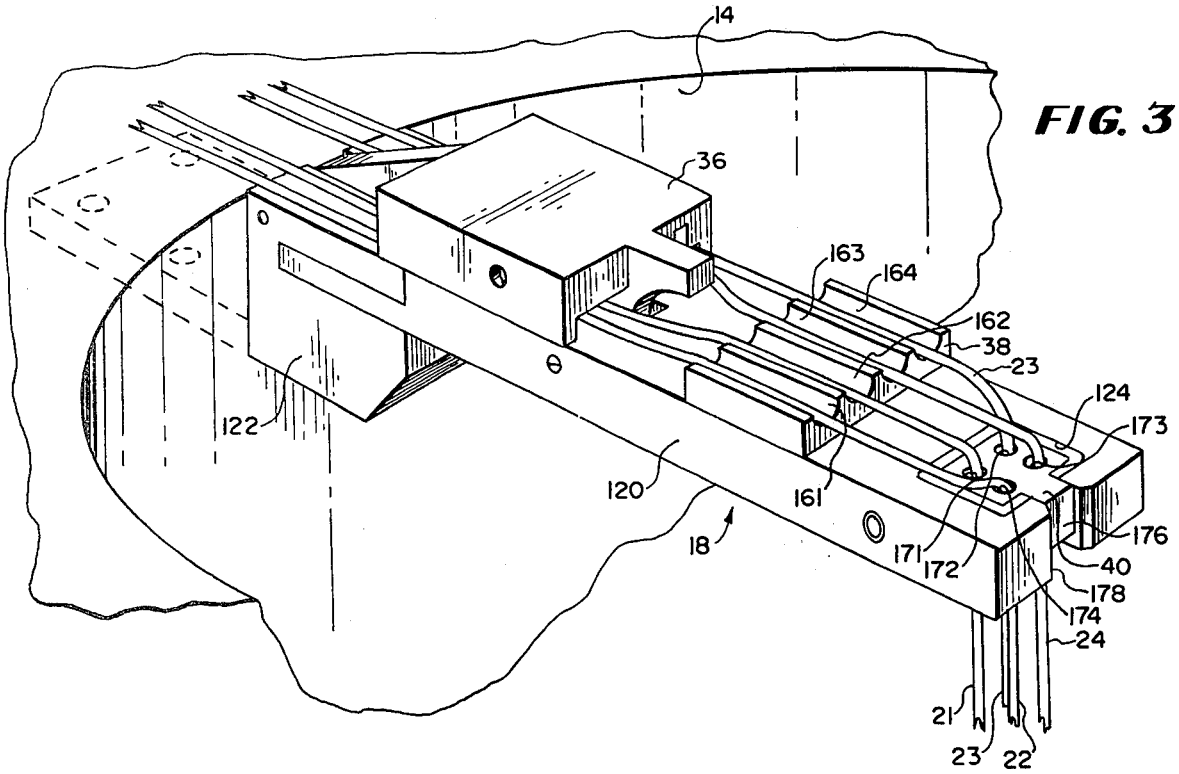
FIG. 3. is an enlarged perspective view of a slightly modified form of the support arm assembly of the apparatus shown in FIG. 1 with a latch arm thereof in a first position.

Referring now to FIG. 3, there is illustrated therein a slightly modified form of the arm assembly 18 which, as described above, includes the latch member 36, the guide member 38 and the apertured holder 40. In FIG. 2 the latch member 36 is shown with two flanges 118 and 119 which are shown straddling an arm position 120 of the assembly 18. However, in the embodiment shown in FIGS. 3-10 the flanges 118 and 119 rest on the top side of the arm portion 120.

As shown, the arm portion 120 is pivotally connected to a base portion 122 which is fixed to the inner side of the cylindrical opening 14.

As will be described in detail hereinafter, the arm portion 120 is latched in place in a first position shown in FIG. 3 to the base portion 122 by the latch member 36. In this position, the outer end of the arm 120 is positioned centrally over the bowl 30. Also, it will be noted that the apertured holder 40 is received and held in an opening 124 located at the outer end of the arm portion 18 thereby to locate the tubings generally on the axis of rotation of the bowl 30.

Figure 4:
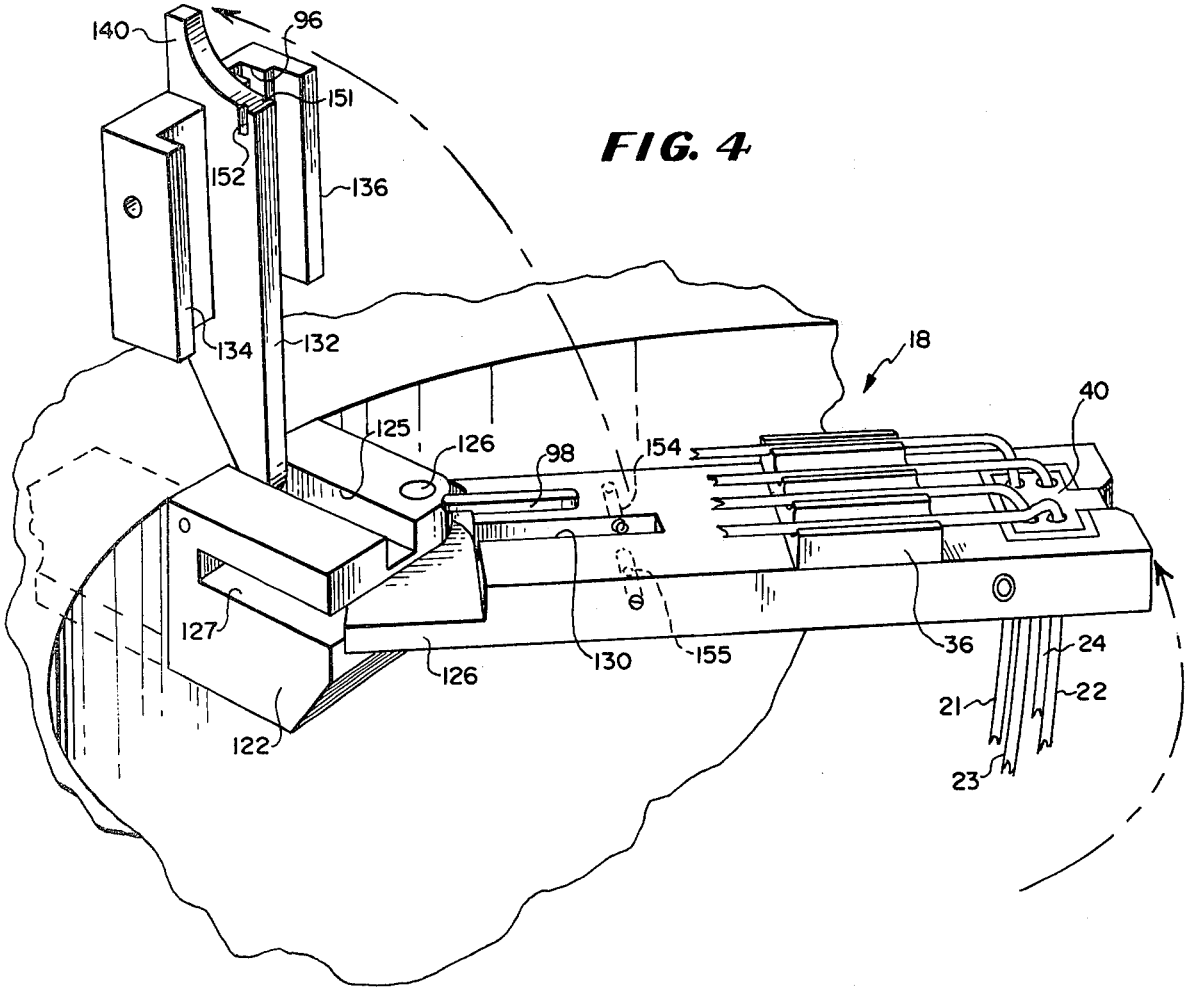
FIG. 4 is a perspective view similar to FIG. 3 except with the latch member of the support arm assembly in a raised second position and an arm portion of the support arm assembly in a second position.

As shown in FIG. 4, the latch member 36 is pivotally connected to the base member 122 and is movable from a first latching position shown in FIG. 1 to a second raised position shown in FIG. 2. In this position the arm portion 120 is permitted to rotate horizontally about a vertical pivot pin 125 fixed in the base portion 22 and a plate portion 126 of the arm portion 120 is movable into and out of a slot 127 in the base portion 122. This arrangement provides a strong mounting of the arm portion 120 to the base portion 122.

As shown, the base portion 122 also has a slot 128 on the upper surface thereof and the arm portion 120 has a similar slot 130 on the upper surface thereof. When the arm portion 120 is in the first position, ends of the slots 128 and 130 are aligned in order to form a continuous slot.

Also, the latch member 36 has a plate or bar portion 132 which is pivoted at an inner end of the slot 128 adjacent the wall 14, such that the bar portion 132, when the latch member 36 is pivoted downwardly to its first position, will be received in the aligned slots 128 and 130, thereby to hold the arm portion 120 to the base portion 122 and against arcuate movement of the arm portion 120.

A short arm 140 extends from the outer end of the latch member 36 to form a gripping or handle means which can be manipulated by a finger to raise the latch member 36.

Figure 8:
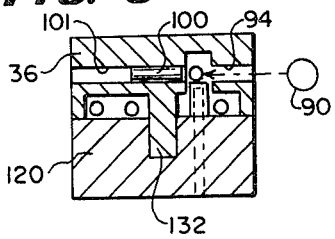
FIG. 8 is a sectional view taken along line 8—8 of FIG. 5.

As shown, the boss 98 is fixed to the arm portion 120 in a position to extend beneath the slot 96 in the latch member 36. As described above, the tubing 23 is trained over the boss 98 and held in the slot 96 so that a light transmissive portion of the tubing 23 is positioned to receive light from the light source 90 through the passageway 94 as best shown in FIG. 8. The passageway 101 is aligned with the passageway 94 and has mounted therein the light pickup device 100 which can be the end of a light pipe or an optical sensor as described above.

Figure 9:
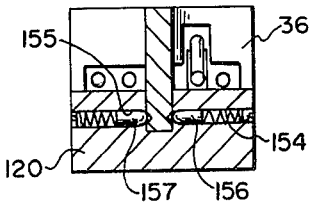
FIG. 9 is a sectional view taken along line 9—9 of FIG. 5.

As shown in FIGS. 4 and 9, the outer end of the bar or plate portion 132 has two small opposed slots 151 and 152 on either side thereof. These slots 151, 152 are adapted to align with horizontally extending passageways 154 and 155 which extend from the sides of the arm portion 120 to the slots 130. As shown in FIG. 9, a pair of spring biased detents 156 and 157 are disposed respectively in the passageways 154 and 155 and are adapted to snap-fittingly engage the slots 151 and 152 when the latch member 36 is in the lower position. This ensures that the bar portion 132 will be held in the aligned slots 128 and 130 when the latch member 36 is in the lower position.

The guide member 38 has four grooves therein 161,162, 163 and 164 for receiving and guiding the tubings 21–24 as best shown in FIG. 3.

The apertured holder 40 received in the opening 124 is preferably made of elastomeric material so that it frictionally engages the tubings 21–24 and can have a squeeze fit in opening 124. As shown in FIG. 3, four parallel spaced apertures 171–174 extend through the holder 40 for receiving the four tubings 21–24. Also, the elastomeric holder 40 has a locating boss 176 which is received in an open slot 178 at the outer end of the arm portion 120.

Figure 6:
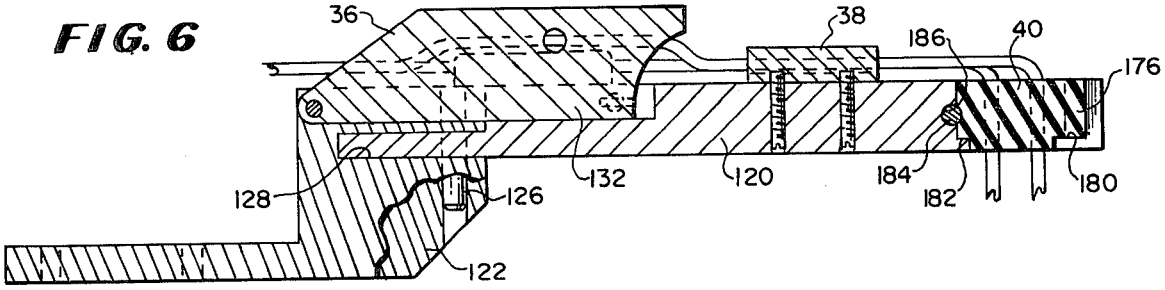
FIG. 6 is a sectional view of the arm assembly shown in FIG. 5 taken along line 6—6 of FIG. 5.
Figure 7:
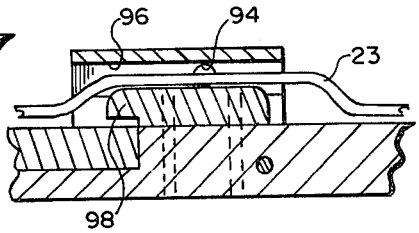
FIG. 7 is a fragmentary sectional view taken along line 7—7 of FIG. 5.

As apparent from FIG. 6, the opening 124 at the end of the arm portion 120 has a shoulder 180 and the holder 40 has a shoulder on the lower edge thereof for resting against the shoulder 180 such that the holder 40 is inserted into the opening 124 from the upper end thereof with the shoulder 182 seated against the shoulder 180.

Figure 5:
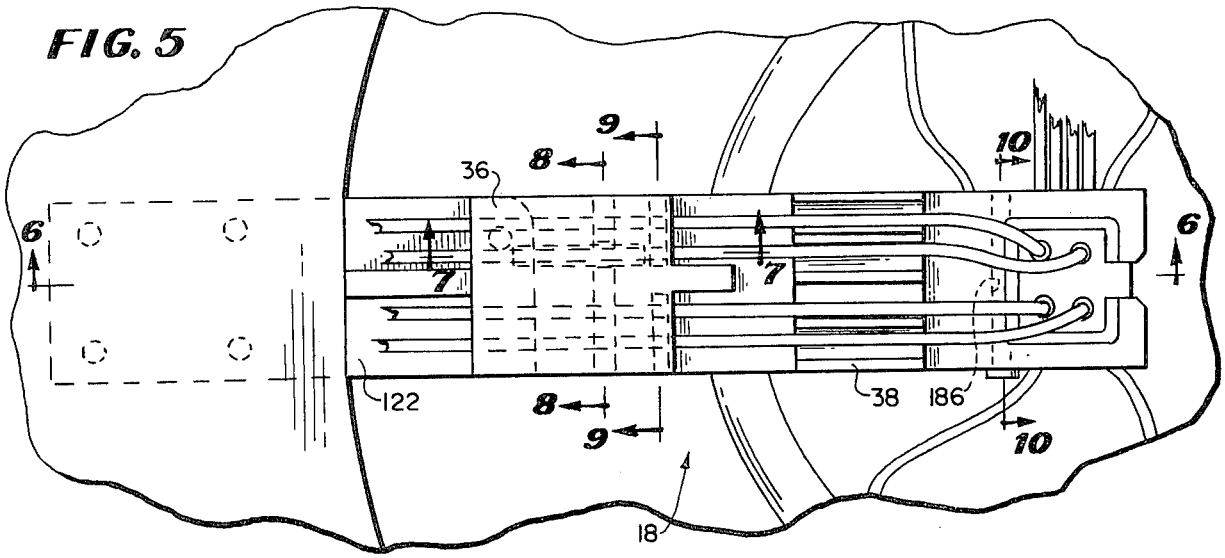
FIG. 5 is an enlarged top plan view of the arm assembly shown in FIG. 3.
Figure 10:
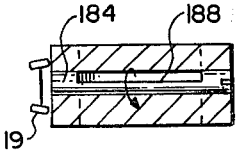
FIG. 10 is a sectional view taken along line 10—10 of FIG. 5.

Also, a cam 184 is mounted in a passageway 186 at one side of the opening 124 as best shown in FIGS. 5, 6 and 10. The cam 184 has a flat portion 188 which, when the cam 184 is rotated so that the flat portion faces the opening 124, will define part of a side wall of the opening 124 to permit the elastomeric holder 40 to be easily inserted into the opening 124. Then, by means of a knob 190 connected to the end of the cam member 184, cam member 184 can be rotated to position a curved portion of the cam member 184 against the holder 40, thereby to hold the same in place as best shown in FIG. 6.

From the foregoing description it will be readily apparent that the support arm assembly 18 of the present invention provides multiple functions, some of which are as follows:

A. The support arm assembly 18 holds the tubings in place over the bowl 30 and directs them downwardly generally on the axis of rotation of the bowl 30 with the pivotal mounting of arm portion 120 permitting horizontal movement thereof to facilitate access to the bowl 30.

B. The holder 40 in the arm assembly 18 serves to frictionally hold the tubings 21–24 in place.

C. The guide member 38 serves to train the tubings on the arm portion 120.

D. The latch member 36 functions not only to hold the arm portion 120 to the base portion 122, but also provides passageways for holding the tubes on the arm and passageways for holding the tubing 23 in a particular slot where passageways 94 and 101 normal to this slot can be used to pass light through the tubing 23 and to pick up the light transmitted through the tubing 23 for controlling automatic collection of white blood cells as described above.

Other advantages of the support arm assembly 18 will be apparent to those skilled in the art. Also, it will be apparent to those skilled in the art that obvious modifications can be made to the support arm assembly 18 of the present invention without departing from the teachings of the invention. Accordingly, the scope of the invention is only to be limited as necessitated by the accompanying claims.

What is claimed is:

1. In an apparatus of the type that includes a centrifuge device having a closed bowl into which liquid is supplied and/or from which liquid is withdrawn by means of at least one flexible tubing and a support arm assembly which is mounted on the apparatus, which extends over the bowl of the centrifuge device, and which has passage means at the free end thereof located centrally of and above the bowl for receiving therethrough the at least one flexible tubing, the improvement residing in said support arm assembly being a pivotal arm assembly which has a base portion fixed to the apparatus and an arm portion pivotally connected to said base portion and pivotal from a first position over the bowl of the centrifuge device to a second position away from the bowl in which second position the bowl can be removed from the centrifuge device.

2. The support arm assembly according to claim 1 wherein said arm portion is pivotally mounted to said base portion for horizontal movement from a position directly over the bowl to a position to the side of and above the bowl.

3. The support arm assembly according to claim 1 including movable latching means for mechanically latching said arm portion to said base portion.

4. The support arm assembly according to claim 3 wherein said latching means is pivotally mounted to said base portion and has a latch portion which engages said arm portion to hold said arm portion in said first position over the bowl.

5. The support arm assembly according to claim 4 wherein said latch portion includes spaced apart depending flanges which are adapted and arranged to be received over and straddle a segment of said arm portion, and which is movable to and from said first, latching position on said arm portion in a direction which is normal to the pivotal movement of said arm portion.

6. The support arm assembly according to claim 4 wherein said base portion and said arm portion each have a slot therein, which slots are aligned, end to end, when said latch portion is in said first, latching position and said latch portion has a bar portion which is received in said aligned slots.

7. The support arm assembly according to claim 6 wherein said arm portion includes means for frictionally engaging said bar portion when said bar portion is received in said slot in said arm portion.

8. The support arm assembly according to claim 3 wherein said latching means includes light supply means and light pickup means mounted thereon and arranged on either side of a light transmissive portion of the at least one tubing.

9. The support assembly according to claim 1 including means for holding the at least one flexible tubing on said support arm assembly.

10. The support arm assembly according to claim 9 for use with an apparatus utilizing several tubings and wherein said holding means includes an elastomeric block having apertures therein through which the flexible tubings extend and being sized to be received in said passage means at said free end of said arm assembly.

11. The support arm assembly according to claim 10 including means for releasably holding said elastomeric block in said passage means.

12. The support arm assembly according to claim 9 including movable latching means for mechanically latching said arm portion to said base portion, said latching means including a latch portion, and wherein said holding means includes said latch portion which is configured and arranged to fit over the tubings to hold them between said latch portion and said base and arm portions of said support arm assembly.

13. The support arm assembly according to claim 4 wherein said latch portion has a handle to facilitate gripping and moving said latch portion.

14. The support arm assembly according to claim 1 wherein said base portion has a slot therein extending transverse to the pivot axis of said arm portion and opening on a side of said base portion facing said arm portion and said arm portion has a plate portion which is movable into and out of said slot and is received in said slot when said arm assembly is in said first position.

* * * * *

UNITED STATES PATENT OFFICE
CERTIFICATE OF CORRECTION

PATENT NO. : 4,127,231

DATED : November 28, 1978

INVENTOR(S) : Mirza A. Khoja, Luis F. Gutierrez and John T. Perone

It is certified that error appears in the above-identified patent and that said Letters Patent are hereby corrected as shown below:

Page 1, Section 75 change "Louis" to --Luis--.

Signed and Sealed this

*Twenty-seventh* Day of *November 1979*

[SEAL]

*Attest:*

RUTH C. MASON
*Attesting Officer*

LUTRELLE F. PARKER
*Acting Commissioner of Patents and Trademarks*